US007134290B2

(12) United States Patent
Awwad et al.

(10) Patent No.: US 7,134,290 B2
(45) Date of Patent: Nov. 14, 2006

(54) PHASE CORRECTION METHOD AND APPARATUS

(75) Inventors: Nader S. Awwad, Baldwinsville, NY (US); John R. Reason, Liverpool, NY (US); Thomas F. Mallinson, Chittenango, NY (US)

(73) Assignee: Carrier Corporation, Farmington, CT (US)

( * ) Notice: Subject to any disclaimer, the term of this patent is extended or adjusted under 35 U.S.C. 154(b) by 313 days.

(21) Appl. No.: 10/892,647

(22) Filed: Jul. 16, 2004

(65) Prior Publication Data

US 2006/0010892 A1 Jan. 19, 2006

(51) Int. Cl.

| | |
|---|---|
| ***F25B 49/00*** | (2006.01) |
| ***F25B 27/00*** | (2006.01) |
| ***H01R 39/46*** | (2006.01) |
| ***H02P 27/00*** | (2006.01) |
| *G01R 25/00* | (2006.01) |

(52) U.S. Cl. ..... 62/126; 62/323.3; 318/439; 318/799

(58) Field of Classification Search ..... 62/126, 62/323.3, 180, 208, 228.4; 318/439, 799, 318/719, 807, 812; 324/76.77, 76.79
See application file for complete search history.

(56) References Cited

FOREIGN PATENT DOCUMENTS

| | | | |
|---|---|---|---|
| JP | 57055778 A | * | 4/1982 |
| JP | 2000023499 A | * | 1/2000 |

* cited by examiner

*Primary Examiner*—Chen Wen Jiang
(74) *Attorney, Agent, or Firm*—Wall Marjama & Bilinski LLP

(57) ABSTRACT

In a transport refrigeration system which is susceptible to having its drive motors connected to a power source in reverse phase relationship to thereby operate the drive motors in reverse, provision is made to measure the current flow to the motors during operation in each direction and for comparing those current flows to determine which is greater and therefore representative of operation in the proper direction. A backup method is also provided for sensing the ambient temperature of the air downstream of the condenser coil, both before and during motor operation to determine whether the temperature during motor operation is greater than that prior to operation to thereby indicate a proper connection.

14 Claims, 4 Drawing Sheets

PHASE CORRECTION METHOD AND APPARATUS

BACKGROUND OF THE INVENTION

This invention relates generally to transport refrigeration systems and, more particularly, to a method and apparatus for sensing and correcting a reverse motor condition when a transport refrigeration system is operating in a stand-by mode.

In a transport refrigeration system, such as a container, truck or truck trailer, for example, the power to operate the compressor and the fan motors of the refrigeration system is derived from a generator or alternator that is driven by the prime mover, i.e. the truck's engine. However, when the truck's engine is shut down, such as when it has reached its destination and waiting to be unloaded, for example, an auxiliary or a stand-by system at the site is relied on to provide that power.

One problem that may occur when operating in stand-by power is that of a phase reversal, such that the electric motors are driven in the wrong direction. This results from that fact that the phase relationships may be reversed from one facility to another, such that a motor driven by the stand-by power may be caused to operate in the proper direction but may, just as well, be caused to operate in a reversed direction. If this occurs, then the motor driven equipment, such as the compressor, a condenser fan or an evaporator fan will not operate efficiently.

One approach that has been employed in refrigerated containers wherein a scroll compressor is used, is that of sensing a pressure differential across the compressor to determine whether it is being driven in the proper direction. While this approach is satisfactory for systems with a scroll compressor, it is not effective when using reciprocating compressors since they have negligible pressure differential between correct and incorrect phasing.

An alternative approach that has been used is to provide a dedicated electronic module to sense and correct phasing during two-phase stand-by operation. With this approach, the electronic module operates to sense the voltage drop across two of the three legs of the three-phase motor to see which phase is leading the others. While this approach is effective, it requires the use of a dedicated module, with its attendant manufacturing and reliability expense.

SUMMARY OF THE INVENTION

Briefly, in accordance with one aspect of the invention, when a transport refrigeration system is first connected to a stand-by power system, it is first connected such that the drive motor is made to operate in a first direction, and the amount of current flow is sensed during that period of operation. The power is then disconnected and reconnected in such a way to cause the motor to operate in the opposite direction, and the current flow is again sensed during that period of operation. The two sensed levels of current flow are then compared and the one drawing the most current is determined to be the correct arrangement.

By another aspect of the invention, a microprocessor is used to store the current flow measurements taken during the two operational periods and then automatically determining which arrangement resulted in the greatest current flow.

In the event that the current sensing approach is not successful in producing a current differential, then a backup system is provided. An existing ambient temperature sensor, which is mounted to the condenser grill, is used for this purpose. If the condenser fan is caused to operate in reverse, the ambient temperature sensor will sense the relatively warm air coming off the condenser coil. That is, if the ambient temperature after start up is greater than the ambient temperature before start up, then the microprocessor will conclude that the phases are reversed.

In the drawings as hereinafter described, a preferred embodiment is depicted; however, various other modifications and alternative constructions can be made thereto without departing from the true spirit and scope of the invention.

DESCRIPTION OF THE PREFERRED EMBODIMENT

Figure 1:
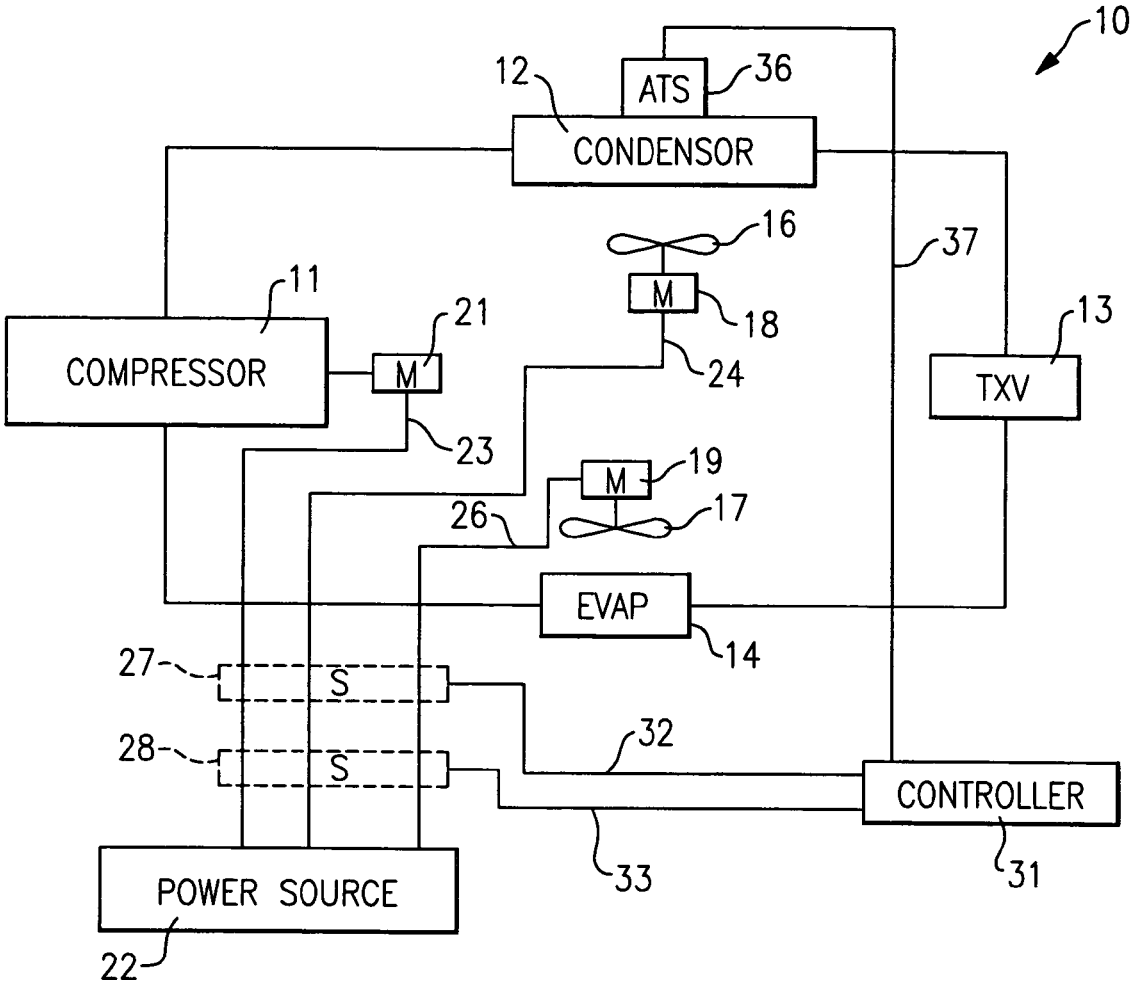
FIG. 1 is a schematic illustration of a transport refrigeration system with the present invention incorporated therein.

Referring now to FIG. 1, the invention is shown generally at 10 as incorporated in a transport refrigeration system including, in serial flow relationship, a compressor 11 a condenser 12 a thermal expansion valve 13 and an evaporator 14. Such a system is typically installed on a truck, trailer or container with the evaporator 14 providing the cooling function to the installation. Other components, such as a heater is normally included but is not shown. Draw-thru fans 16 and 17 are provided for the condenser 12 and evaporator 14, respectively. The condenser fan 16 is driven by a motor 18 and the evaporator fan 17 is driven by the motor 19. the compressor 11 is driven by a motor 21. Each of these three drive motors are normally three-phase AC motors.

In normal periods of operation, such as when the vehicle is in transit, power to the transport refrigeration system is provided by way of a generator or an alternator that is powered by the prime mover. When that vehicle is shut down, such as when it is parked at a facility awaiting loading or unloading. The transport refrigeration system is caused to operate in a stand-by condition wherein a power source at the facility is connected to the system. Such a power source is shown at 22 and is connected to the compressor motor 21 by line 23, to the condenser motor 18 by the line 24, and to the evaporator motor 19 by line 26. Current sensors 27 and 28 are provided to sense the current flow in lines 23, 24 and 26, respectively. A controller 31 is, in turn, connected to the sensors 27 and 28 by lines 32 and 33, respectively. The sensing of current flow to the motors 18, 19 and 21 is important in the implementation of the present invention as will be discussed hereinbelow. In this regard, it should be mentioned that the current sensors are commonly included in such a system for other purposes, such as that of controlling total power.

As discussed hereinabove, a problem that can occur with the connection to a power source 22 is that, because of the different phase relationships that exist at the various power sources, a reversed phase relationship can exist, which will cause the drive motors to operate in reverse. This will, of course, cause inefficiencies in the system and should be avoided.

While the current measuring approach is the primary method used for determining whether the power source 22 is connected in proper phase relationship, a backup method is also provided, using preexisting components. A common component in such transport refrigeration system is an ambient temperature sensor with its output passing to the controller 31 for proper control of the unit. In the present system the ambient temperature sensor 36 is placed on the air inlet side of the condenser 12 as shown and connected to the controller by line 37. The manner in which this is used as a backup method to determine whether the phase relationship is correct will be described more fully hereinafter.

Figure 2:
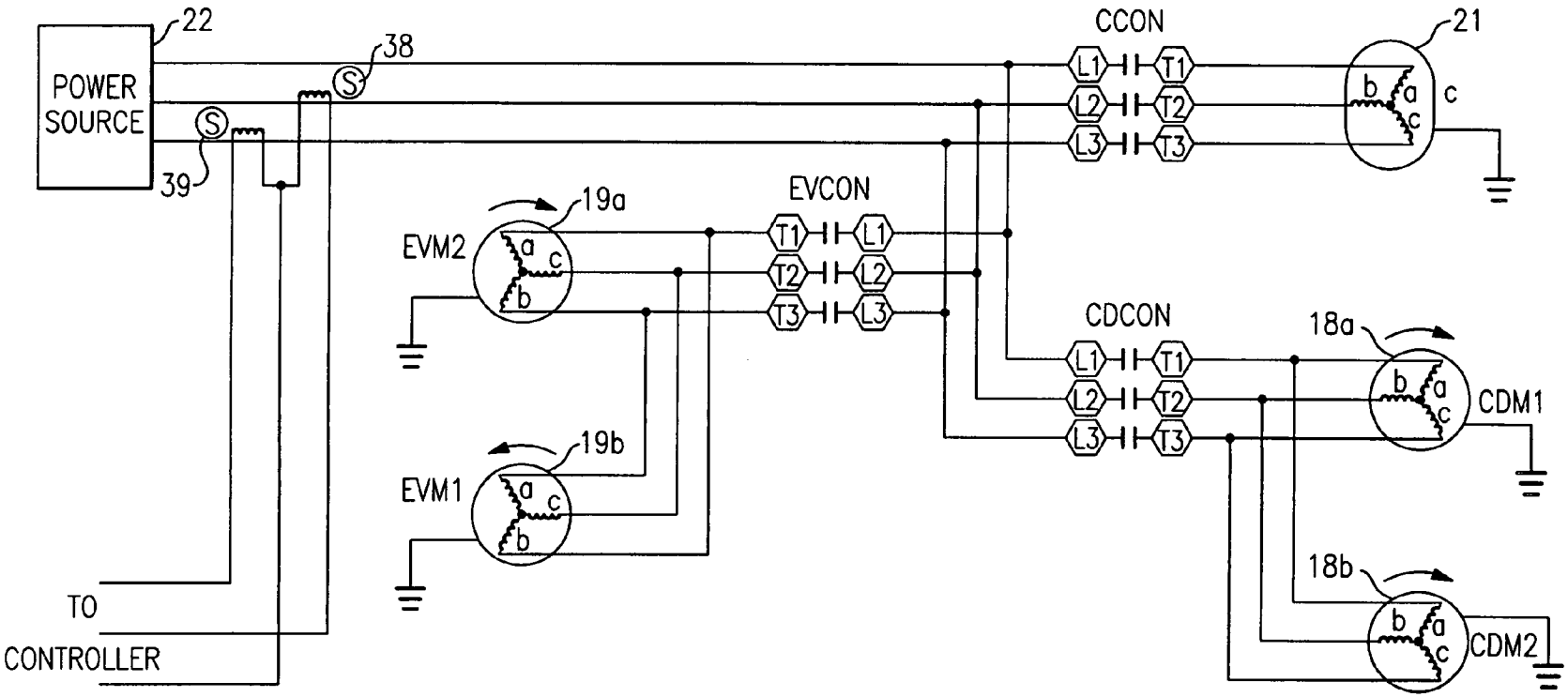
FIG. 2 is a circuit diagram of a portion thereof showing particular components of interest.

Referring now to FIG. 2, the circuitry for providing power to the motors is shown. The motors include the compressor motor 21, the condenser motors 18*a* and 18*b*, and the evaporator fan motors 19*a* and 19*b*. The motors are all three phase motors with legs a, b and c as shown. The power source 22 is connected to each of the motors by way of contactors that are controlled by the controller 31. That is, in the compressor drive motor 21 is connected by way of contactors CCON, the condenser motors 18*a* and 18*b* are connected by way of contactors CDCON, and the evaporator fan drive motors 19A and 19B are connected by way of contactors FCON. Current sensors 27 and 28 are provided to measure the current for purposes of determining whether the motors are properly connected in phase as will be more fully described hereinafter.

Figure 3A:
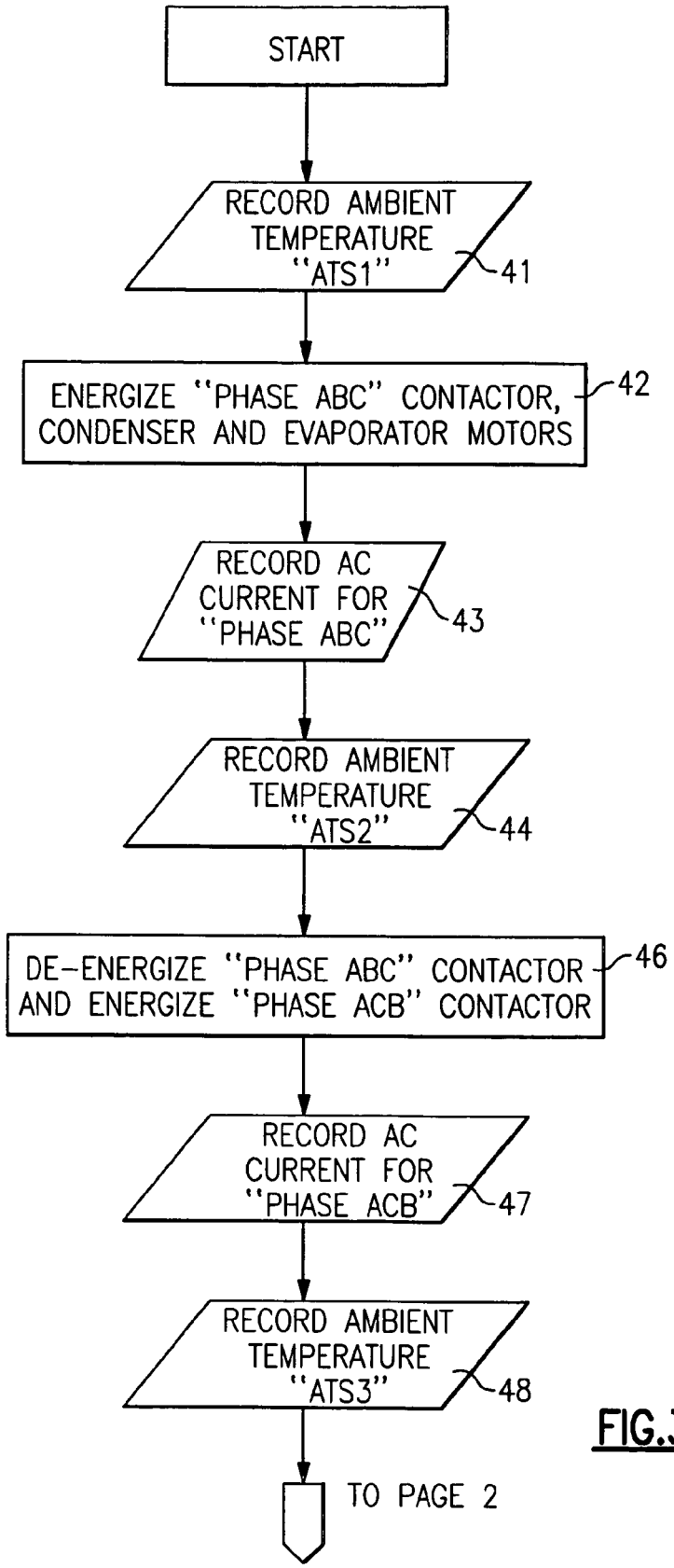
FIGS. 3A and 3B illustrate a flow chart showing a method in accordance with one aspect of the invention.
Figure 3B:
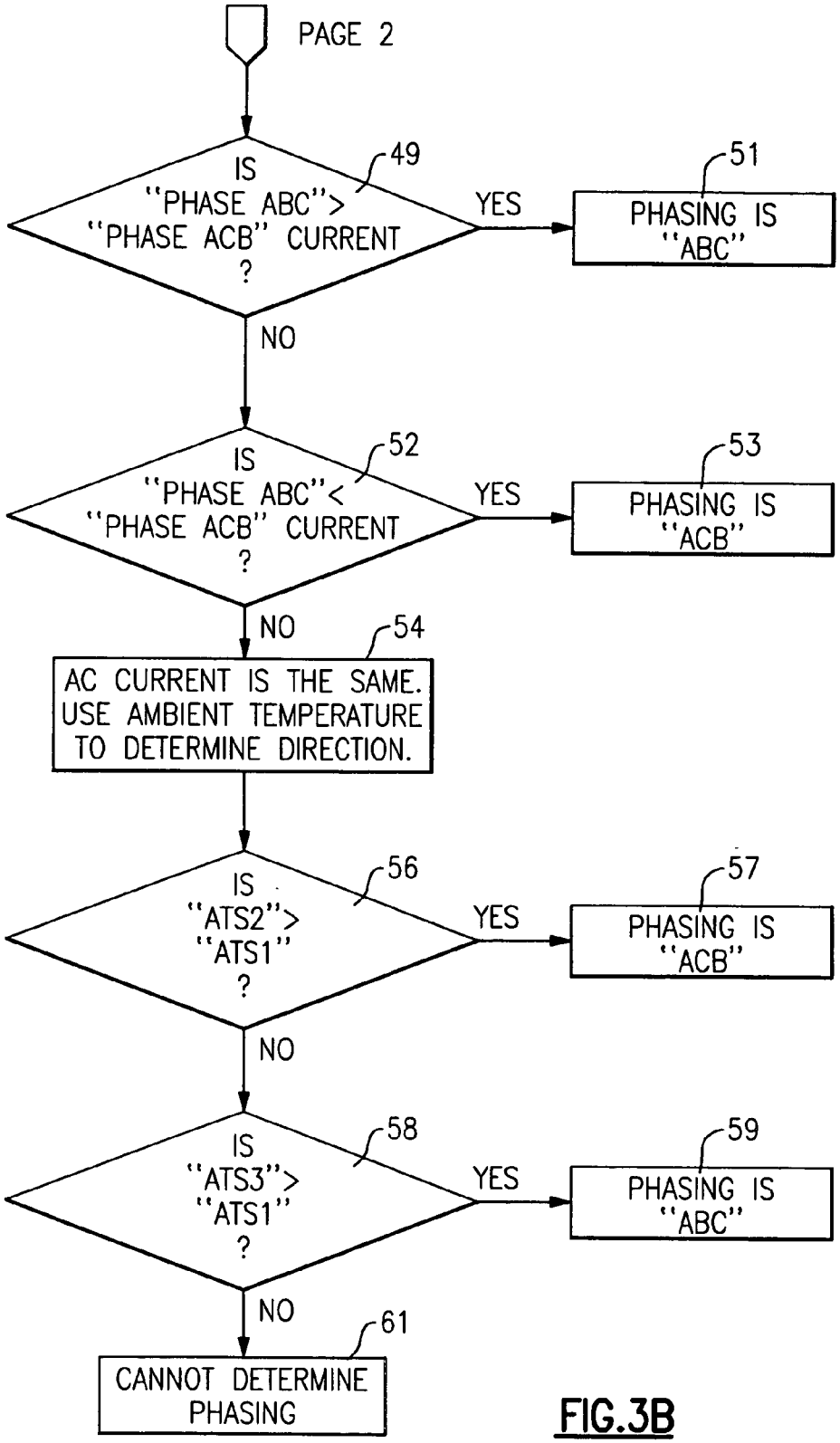

The method, in accordance with one embodiment of the invention, is shown in FIG. 3A and 3B. For use in the backup method, the ambient temperature (ATS1) is first measured and recorded in the controller 31, as shown at block 41.

The contactors CDCON and EVCON are then closed to energize "phase abc" of their respective motors as shown in block 42. The current sensors 27 and 28 are then used to sense and record the AC current for "phase abc" as shown in block 43.

Again, for purposes of the backup approach, the ambient temperature ATS2 is measured and recorded as shown at block 44. This may or may not be used, depending on the success of the primary method.

The CDCON and EVCON contactors are then opened to de-energize the "phase abc" mode and the contactors are then closed to energize the "phase acb" mode of operation as shown in block 46. Again, the current sensors 27 and 28 are used to measure and record the AC current for those "phase acb" periods of operation as shown in block 47.

In block 48, a third ambient temperature "ATS3" is measured and recorded for the backup method.

In block 49, the two measurements for "phase acb" and "phase acb" are compared to determine which is greater, which would indicate that more work was being done and therefore the correct phase relationship. Thus, if "phase abc" is greater than "phase acb", the correct phasing is "abc" as shown in block 51. On the other hand, if the "phase abc" is not greater than "phase acb" current, then we pass to block 52 wherein a determination is made as to whether the "phase abc" is less than "phase acb" current. If it is, then the correct phasing is "acb" as shown in block 53. If those currents are the same, then we can determine that this method has been inconclusive, and we need to use the backup method as shown in block 54.

In block 56, the stored temperatures are compared to determine whether "ATS2" is greater than "ATS1". If it is, we can conclude that the fan motor 18 is operating in reverse with the hot air of the condenser is being blown over the sensor 36, and therefore the correct phasing is "acb" as shown in block 57. If it is not, then we pass to block 58 wherein a comparison is made between ATS3 and ATS1. If "ATS3" is greater than "ATS1" then we can conclude that the proper phasing is "abc" as shown in block 59. If "ATS3" is not greater than "ATS1" then we can determine that the backup method is not conclusive either. In such a case, it would be necessary for the operator to investigate and determine why neither of these two methods were successful.

While the present invention has been particularly shown and described with reference to a preferred embodiment as illustrated in the drawings, it will be understood by one skilled in the art that various changes in detail may be affected therein without departing from the true spirit and scope of the invention as defined by the claims.

We claim:

1. A method of determining whether a 3 phase motor is rotating in the proper direction, comprising the steps of:

energizing the motor to operate in one direction for a first preselected period of time;

measuring the current flow to the motor during said first period of time and recording the first measurement;

energizing the motor to run in the other direction for a second preselected period of time;

measuring the current flow to the motor during said second period of time and recording the second measurement;

comparing said first and second measurements to determine which is greater and therefore in proper phase relationship.

2. A method as set forth in claim 1 wherein said motor is a drive motor in a transport refrigeration system.

3. A method as set forth in claim 2 wherein said motor is an evaporator fan drive motor.

4. A method as set forth in claim 2 wherein said motor is a condenser fan drive motor.

5. A method as set forth in claim 1 wherein said comparing step is accomplished by determining whether the first measurement is greater than the second measurement.

6. A method as set forth in claim 5 and including the further step of determining whether said first measurement is less than the second measurement.

7. A method as set forth in claim 1 wherein the motor is in a transport refrigeration system that is susceptible to being connected to a power source in reverse phase relationship.

8. A method as set forth in claim 7 wherein said transport refrigeration system includes a condenser coil and a fan for circulating air over said condenser, and the method includes the further steps of:

measuring the ambient temperature of the air flowing at the downstream side of the condenser prior to energizing the motor, measuring the ambient temperature of the air on the inlet side of the condenser after the motor is energized; and comparing the temperature measurements to determine which is greater.

9. An improved transport refrigeration system of the type having a plurality of three-phase motors which are periodically connected to different power sources so as to be susceptible to being connected in a phase relationship such that the motors are caused to operate in reverse comprising:

at least one current measuring device for measuring the current flow to at least one of said motors when operating in one direction and for subsequently measuring the current flow to said at least one motor when operating in the other direction; and a comparator for comparing the two measured current flows to determine which is greater and therefore in proper phase relationship.

10. An improved transport refrigeration system as set forth in claim 9 wherein one of said motors is an evaporator fan drive motor.

11. An improved transport refrigeration system as set forth in claim 9 wherein one of said motors is a condenser fan drive motor.

12. An improved transport refrigeration system as set forth in claim 9 wherein said comparator is applied to determine whether the first measured current is greater than the second measured current.

13. An improved transport refrigeration system as set forth in claim 12 wherein said comparator is applied to further determine whether the second measurement is greater than the first.

14. An improved transport refrigeration system as set forth in claim 9 and further including an ambient temperature sensor for measuring the temperature of the air flow upstream of the condenser both before and after the system is connected to the power source; and a comparator for comparing the two measured temperatures to determine which is the greater.

* * * * *

UNITED STATES PATENT AND TRADEMARK OFFICE

CERTIFICATE OF CORRECTION

PATENT NO. : 7,134,290 B2
APPLICATION NO. : 10/892647
DATED : November 4, 2006
INVENTOR(S) : Awwad et al.

It is certified that error appears in the above-identified patent and that said Letters Patent is hereby corrected as shown below:

Column 3, line 47, delete “phase acb” and insert --phase abc--.

Signed and Sealed this

Thirteenth Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,134,290 B2
APPLICATION NO. : 10/892647
DATED : November 14, 2006
INVENTOR(S) : Awwad et al.

It is certified that error appears in the above-identified patent and that said Letters Patent is hereby corrected as shown below:

Column 3, line 47, delete “phase acb” and insert --phase abc--.

This certificate supersedes Certificate of Correction issued February 13, 2007.

Signed and Sealed this

Sixth Day of March, 2007

JON W. DUDAS
*Director of the United States Patent and Trademark Office*